US005492067A

United States Patent [19]

Anderson

[11] Patent Number: 5,492,067

[45] Date of Patent: Feb. 20, 1996

[54] SYSTEM AND METHOD FOR MAINTAINING PLURAL DRIVEN COMPONENTS AT REFERENCE POSITIONS

[75] Inventor: Kevin J. Anderson, South Boston, Va.

[73] Assignee: Harnischfeger Corporation, Brookfield, Wis.

[21] Appl. No.: 287,514

[22] Filed: Aug. 8, 1994

[51] Int. Cl.[6] ..... B61D 1/00

[52] U.S. Cl. ..... 105/163.2

[58] Field of Search ..... 105/163.2, 73; 104/295; 303/111; 414/561, 562; 180/167, 168; 212/153

[56] References Cited

U.S. PATENT DOCUMENTS 3,703,016 11/1972 Schramm ..... 105/163.2

FOREIGN PATENT DOCUMENTS 490185 6/1992 European Pat. Off. ..... 105/163.2

160288 2/1963 U.S.S.R. ..... 105/163.2

1054277 1/1982 U.S.S.R. ..... 105/163.2

1253939 11/1984 U.S.S.R. ..... 105/163.2

1581679 7/1990 U.S.S.R. ..... 105/163.2

*Primary Examiner*—Robert J. Oberleitner

*Assistant Examiner*—C. T. Bartz

*Attorney, Agent, or Firm*—Jansson & Shupe, Ltd.

[57] ABSTRACT

The disclosure involves a machine, e.g., a portal crane, having two components such as bridge support legs or rail-riding trucks. Each component is driven by a separate motor and each is moving at a speed, perhaps a different speed. A method for maintaining the speeds of the two components substantially equal to one another includes the steps of providing a differential signal representing a difference between the speeds of the two components and generating an equalizing signal reducing the speed of the higher-speed component. Preferably, a second equalizing signal is also generated to increase the speed of the lower-speed component. A new drive system is also disclosed. The method and system are particularly useful for maintaining the "squareness" of a double-leg portal crane.

19 Claims, 3 Drawing Sheets

OPERATOR SPEED REFERENCE
INTERFACE
DIFFERENTIATOR
LIMITER
INTEGRATOR
SLOW DOWN
K
K 1
K 2
K 3
K 4
K 5
K 6
DIFFERENTIATOR
THRESHOLD LIMIT COMPARATOR
INTEGRATOR

SYSTEM AND METHOD FOR MAINTAINING PLURAL DRIVEN COMPONENTS AT REFERENCE POSITIONS

FIELD OF THE INVENTION

This invention relates to motive power systems and, more particularly, to electrical motive power systems.

BACKGROUND OF THE INVENTION

Electrical motive power systems are used to drive many types of mobile machines. Diesel-electric locomotives, electric cars and material-handling cranes are but a few examples of machines driven by electric motors.

For the person engineering the motive power system, one type of material-handling crane presents an unusual problem. A so-called portal crane, often referred to as a gantry crane, is shaped like an inverted "U" and the lower ends of its two spaced support legs are attached to wheeled "trucks" which ride atop spaced rails. Each leg and truck component is driven by a separate motor and each moves at a particular speed. And while it is intended that both legs move simultaneously and at the same speed, this is not always the case.

The electric motors driving the legs are mechanically separated. That is, there is no mechanical connection, e.g., by a line shaft or the like, between the motors. Rather, such motors are free (within certain limits) to run at different speeds and at different rates of acceleration. Under certain crane operating conditions, the fact of "mechanical disconnectedness" results in undesirable crane skewing.

The legs support a horizontal "bridge" positioned well above the ground or floor and on which a loadhandling "trolley" moves. The crane is arranged so that the trolley can move along the entire distance between the legs. Often, the bridge extends beyond at least one of the legs and the trolley can also move "outboard" of that leg, i.e., along such extended bridge length.

In a typical portal crane, one leg (often referred to as a "fixed leg") is rigidly attached to the bridge while the other leg, often referred to as the "hinged leg," has limited freedom of motion to pivot about an axis along the bridge and in a plane coincident with the hinged leg. Because of the rigid attachment of the fixed leg and the bridge, that leg can (and for reasons explained below, sometimes does) "pull along" the bridge and the other leg. This tends to skew the crane.

Skewing often arises because the legs are unevenly loaded—one leg tends to lead the other. If the trolley and its load are very near, over or even outboard of one leg, that leg will be more heavily loaded and will tend to lag and move more slowly. And portal cranes are often used outdoors. "Wind loading," i e. the force resulting from wind blowing against the trolley, cab and load, can cause skewing if the trolley is nearer one leg than the other. And the crane control house, that enclosure in which electrical equipment is housed, may be located nearer one leg than the other. Such house is exposed to the wind. Additionally, it should be appreciated that wind loading need not only tend to slow one leg of the crane. Eccentric crane loading and wind can tend to accelerate and cause one leg to lead, depending upon wind direction and the direction of crane travel.

While portal cranes are designed to accept and withstand a modest amount of skewing, almost any amount of skewing tends to put additional stress on parts of the crane. And excessive skewing can stress such parts unduly and cause premature failure.

One approach that helps prevent undue skewing is to simply manipulate the master switch less "aggressively" so that rates of acceleration and speeds do not become badly mismatched. However, the utility of the crane is thereby impaired; it simply does not operate at the increased "duty cycle" that, in view of the invention, is now possible.

("Duty cycle" may be explained in terms of the time required for a machine to make one load-handling round trip. The longer such required time, the lower the duty cycle. Clearly, duty cycle is a measure of machine productivity and the ability of the crane owner to attain a satisfactory return on the substantial investment.)

An approach that has been used to prevent undue skewing involved a so-called "bang bang" control, an operating principle of which was to momentarily shut off the electric motor driving the leading leg of the crane. But this approach was not effective during the initial 10–15 seconds over which the crane was accelerating from, say, a standstill. The main control system did not respond to the "shut off" signal until after initial crane acceleration. But by then, structural damage may have occurred.

An improved system and method overcoming some of the problems and shortcomings of the prior control systems would be an important advance in the art.

OBJECTS OF THE INVENTION

It is an object of the invention to provide an improved drive system and method overcoming some of the problems and shortcomings of the prior art.

Another object of the invention is to provide an improved system and method useful with two or more independently-powered components of a mobile machine.

Another object of the invention is to provide an improved system and method wherein the speeds and rates of acceleration of plural mechanically-separated electric motors are substantially equalized.

Yet another object of the invention is to provide an improved system and method which help prevent substantial skewing in a portal crane.

Still another object of the invention is to provide an improved system and method which help match acceleration rates of legs of a portal crane.

Another object of the invention is to provide an improved system and method which maximizes the duty cycle of a material handling portal crane while yet avoiding crane skewing.

Another object of the invention is to provide an improved system and method useful to prevent skewing of a portal crane even during initial crane acceleration. How these and other objects are accomplished will become apparent from the following descriptions and from the drawing.

SUMMARY OF THE INVENTION

The invention is described in connection with a material handling machine such as an exemplary portal crane, sometimes called a gantry crane. A crane of this type is shaped like an inverted "U" and the lower ends of its two spaced support legs (which support a horizontal "bridge") are attached to wheeled "trucks" which ride atop spaced rails. Each leg and each truck component is driven by a separate motor and each moves at a particular speed and accelerates at a particular rate of acceleration.

Ideally, such speeds and rates of acceleration are always equal to one another but that is not always achieved in practice. The "thrust" of the invention is to modify disparate component speeds and rates of acceleration so that the driven components are maintained substantially coincident with a reference position. As an example, a reference position may be coincident with an imaginary horizontal axis normal to and intersecting the crane rails. When the driven components are so maintained, machine "skewing" and resulting undue machine stress are substantially avoided.

A method for maintaining the positions of each of the components substantially coincident with a component reference position includes the steps of providing a differential signal representing a difference between the speeds of the two components. An equalizing signal is generated to reduce the rate of acceleration of the higher-speed component. In the alternative (or in addition), an equalizing signal is generated that increases the rate of acceleration of the lower-speed component.

A rate-of-acceleration reference signal (a signal that "tells" the control the rate at which the machine is supposed to accelerate) is provided when the operator's master switch is moved to a particular position away from neutral or "off." Such reference signal is algebraically combined with the equalizing signal and the latter "artificially" decreases (or, in the alternative, increases) the value of the rate-of-acceleration reference signal for a particular motor.

More specifically, the step of providing a differential signal includes the steps of generating a first signal representing the speed of the first component, generating a second signal representing the speed of the second component and algebraically summing the first signal and the second signal to provide a summation signal. Each of the first and second signals representing speeds are conveniently provided by a separate pulse-type shaft encoder that emits output pulses at a rate proportional to the speed of the particular component to which it is coupled.

Preferably, the providing step also includes the step of applying a differential function to the summation signal and thereby generating a velocity signal. Such velocity signal has (a) a magnitude representing the difference between the speed of the first component and the speed of the second component and (b) a polarity denoting that component having the greater speed.

As will be appreciated from the above description, disparate rates of component acceleration may be brought to substantial equality solely by decreasing the rate of acceleration of that component moving at the greater speed. However, in a highly preferred method, a second equalizing signal is also generated and such signal is used to increase the rate of acceleration of the lower-speed component.

Other "apparatus" aspects of the invention relate to a drive system having (a) a device for providing a motor rate-of-acceleration reference signal, (b) first and second motors driving first and second components, respectively, and (c) first and second drives receiving the reference signal and powering the first and second motors, respectively. An improved drive system includes a first circuit for generating a velocity signal having (a) a magnitude representing the difference between the speed of the first component and the speed of the second component, and (b) a polarity denoting that component having the higher speed. Such system also has a second circuit for receiving the velocity signal and applying a first modified rate-of-acceleration reference signal to the first drive.

In one preferred drive system, the second circuit also applies a second modified rate-of-acceleration reference signal to the second drive. The first modified reference signal tends to reduce the rate of acceleration of the first motor and the second modified reference signal tends to increase the rate of acceleration of the second motor.

Further details of the invention are set forth in the detailed description and in the drawing.

DETAILED DESCRIPTIONS OF PREFERRED EMBODIMENTS

Figure 1:
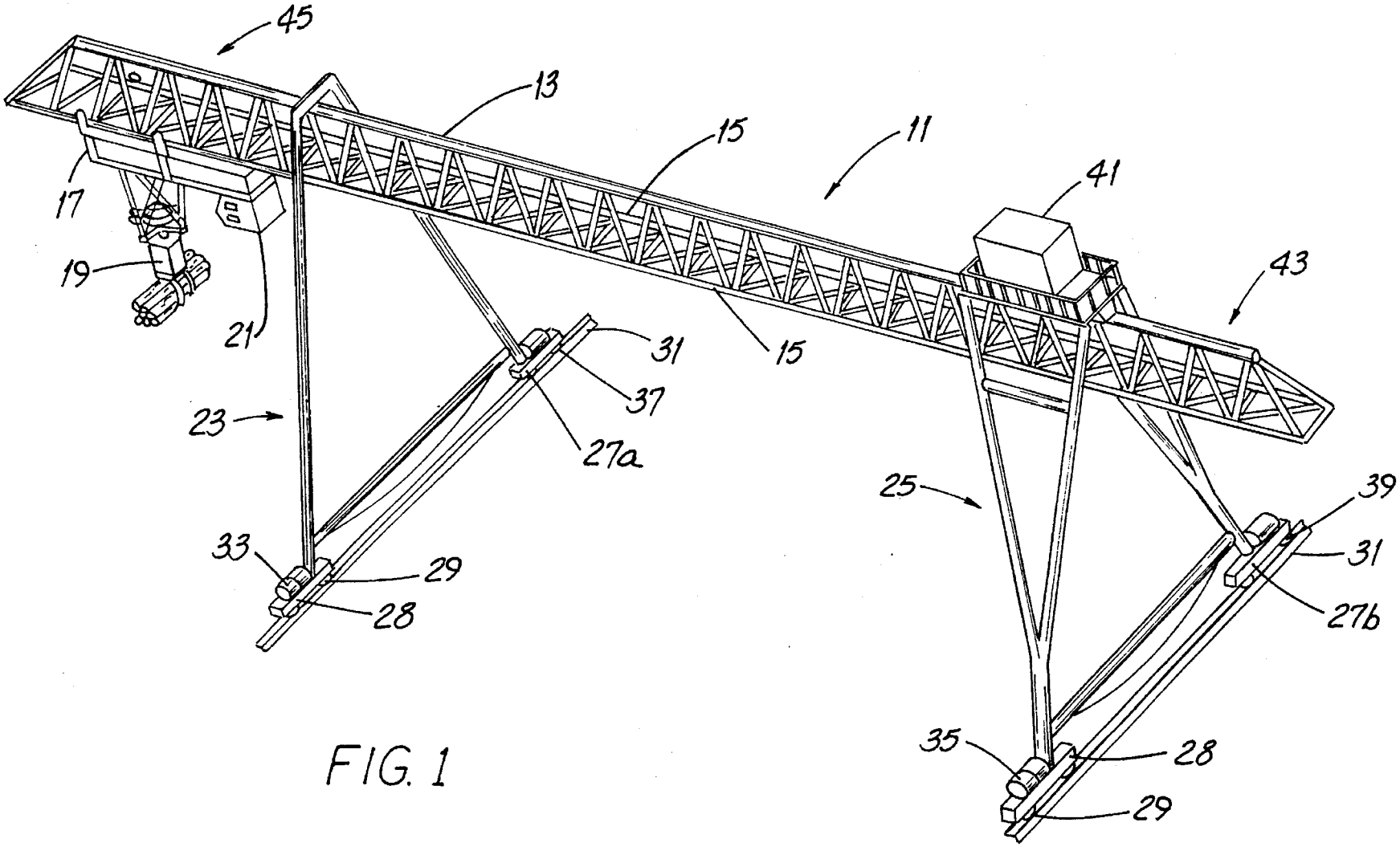
FIG. 1 is an exemplary perspective view of a material handling machine (embodied as a portal crane) with which the invention may be used.

Before describing the inventive drive system 10 and the new method, it will be helpful to have a basic understanding of but one machine with which the new system 10 and method may be used. FIG. 1 illustrates an exemplary type of material handling machine known as a portal crane 11, sometimes referred to as a gantry crane. The crane 11 has a bridge 13 equipped with a pair of railroad-type rails 15 running the length of the bridge 13. A wheeled trolley 17 rides on such rails 15 and extending down from the trolley 17 is a load-handling apparatus 19. A grapple for handling logs is illustrated.

And the load-handling apparatus 19 is not the only thing attached to and carried by the trolley 17. In the illustrated crane 11, the operator's cab 21 is also suspended from and travels with the trolley 17. Master switches and other controls in such cab 21 enable an operator to control the speed and direction of all crane motions, i e., the "hoist," "bridge" and "trolley" motions.

The bridge 13 is supported by a pair of inverted V-shaped legs 23, 25, the upper parts of which are attached to such bridge 13. The lower ends of the legs 23, 25 are equipped with wheeled "trucks" 27 and like the trolley 17, the trucks 27 are equipped with steel, flanged railroad-type wheels 29 which ride atop rails 31.

One truck on each leg 23, 25, e.g., each truck 28, has a wheel powered (through appropriate gear reduction) by an electric drive motor 33, 35. When the system 10 is shut down, a spring-set, magnetically-released brake prevents each motor 33, 35 from rotating and holds the crane 11 stationary on the rails 31.

Of course, the rate of acceleration, speed and direction of rotation of the motors 33, 35 control the rate of acceleration, speed and direction of movement of the crane 11 as it moves along the rails 31. Under conditions of poor traction, a driven wheel may slip and for that reason, the encoders (described below) used with the invention are coupled to non-driven first and second idler wheels 37, 39, respectively.

The idler wheels 37, 39 do not slip under conditions of poor traction; the function of such wheels 37, 39 is merely to support load, not provide motive power. Therefore, the rotational speed of each wheel 37, 39 is directly related to the travel speed of the leg 23, 25, respectively, associated therewith.

From the foregoing, several facts are apparent. One is that when the trolley 17 and its suspended load are anywhere but at a position midway between the legs 23, 25, one leg (that to which the trolley is in closer proximity) is more heavily loaded than the other leg. Another is that wind blowing against the sides of the trolley 17 and the control house 41 exerts a generally horizontal force and tends to accelerate portions of the crane 11 in the direction of the wind or slow such portions if the crane 11 is travelling against the wind.

And if the trolley 17 is generally adjacent to the control house 41, wind forces against the end 43 of the crane 11 are cumulative and have an even greater tendency to accelerate the end 43 to a speed greater than that of the end 45. Wind and/or eccentric loading tend to cause one truck, e.g., the truck 27, to accelerate at a rate different than that of the other truck 28 and skew the crane 11. The invention represents a substantial advance in resolving such differentials in truck rates of acceleration and speed.

Figure 2:
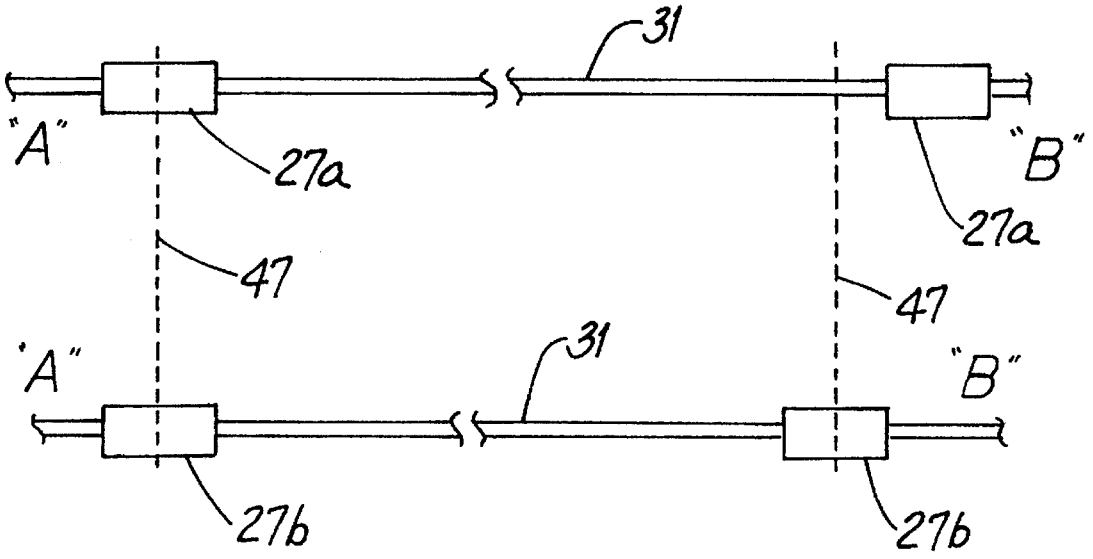
FIG. 2 is a representative top plan view of a portion of the crane of FIG. 1 shown in conjunction with reference axes.

Referring also to FIG. 2, portions of this specification mention reference positions and maintaining the position of a driven component at a reference position or restoring such component to such position. In FIG. 2, a reference axis 47 is horizontal and generally normal to the rails 31. When the trucks 27*a*, 27*b* are in the positions marked "A," such axis 47 intersects the idler wheels 37, 39 of such trucks 27*a*, 27*b*. No skewing or "twisting" forces are then being exerted on the crane 11. On the other hand, when the trucks 27*a*, 27*b* are in the positions marked "B" it is very apparent that the crane 11 is markedly skewed and unduly stressed. And, of course, it is to be appreciated that skewing occurs if the truck 27*b* is coincident with the axis 47 and the truck 27*a* is to the left or right of the axis 47 (as shown) or if the truck 27*a* is coincident with the axis 47 and the truck 27*b* to the left or right of the axis 47, all as viewed in FIG. 2.

Figure 3:
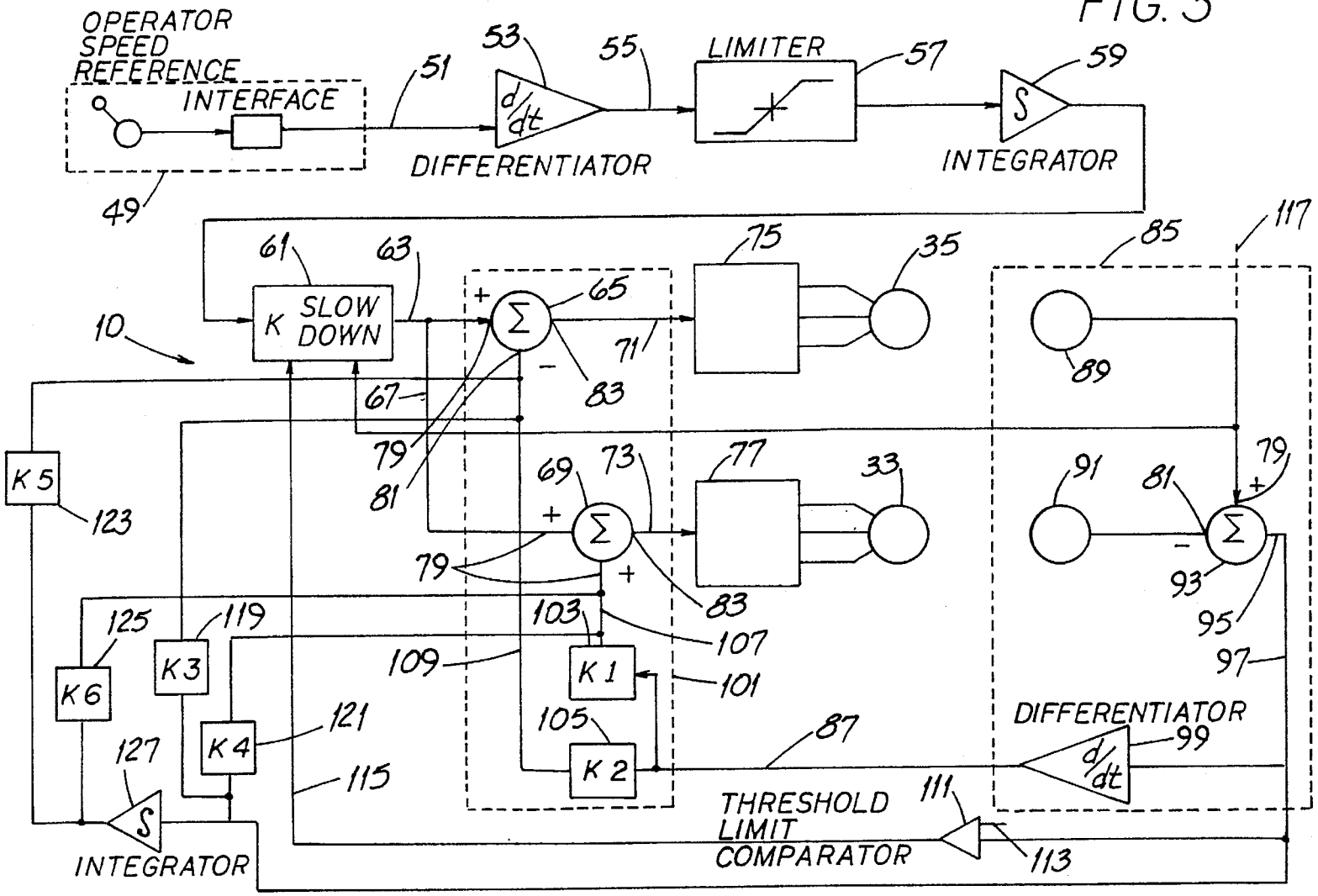
FIG. 3 is a block circuit diagram of the inventive system.

Referring also to FIG. 3, the drive system 10 has an operator's master switch 49 that provides an output signal along the line 51. A preferred signal is an analog signal, e.g., 0–10 volts and the magnitude of such output signal represents the final steady-state speed to be attained. In one preferred approach, a separate signal is used for each direction of movement of, say, the bridge 13 or the trolley 17. In another approach, the output signal has both magnitude and polarity with magnitude representing the desired steady-state speed and polarity representing the direction of travel.

A differentiator 53 "operates" on the output signal and provides an initial signal along the line 55. If the signal along the line 55 represents a rate of acceleration in excess of that set in the rate-of-acceleration limiter 57, the latter rate is the maximum attainable. An integrator 59 operates on the signal from the limiter 57 and after applying a slowdown gain constant using a gain constant circuit 61, a rate-of-acceleration command signal (also referred to as a rate-of-acceleration reference signal) is directed along the line 63.

Such signal is directed to a first summing device 65 (often referred to as a "summer") and along the line 67 to a second summing device 69. The devices 65, 69 are connected along the lines 71 and 73, respectively, to first and second adjustable frequency drives 75 and 77, respectively.

In turn, the drives 75 and 77 are connected respectively to the motor 35 driving the truck 28 supporting the fixed-leg 25 and to the motor 33 driving the truck 28 supporting the hinged leg 23. The adjustable frequency drives 75, 77 are of a known type providing motor output power at a voltage and a frequency generally proportional to the analog signals on the lines 71 and 73, respectively.

It is to be noted that if the summing devices 65, 69 are omitted from the lines 71 and 73, respectively, both drives 75, 77 will receive the same command or reference signal along the lines 71, 73, i.e., that signal which "tells" the drives 75, 77 the rate at which both motors 33, 35 should be accelerated and the speed at which they should run. If the legs 23, 25 are equally loaded, if the rolling friction of the trucks 28 is substantially the same and if the crane 11 operates in a windless environment, both legs 23, 25 will move at substantially the same speed. However, those operating conditions are ideals rarely if ever found in a portal crane 11.

(By way of brief parenthetical explanation, a summing device, like devices 65, 69 has one or more non-inverting terminals 79 identified by a "+" sign and one or more inverting terminals 81 identified by a "–" sign. Even though two signals applied to the terminals 79, 81 might both be positive in polarity, the device 65 inverts a signal applied to a terminal 81 before algebraically summing such signals. If the signal applied at the terminal 79 is larger, the resultant signal at the output terminal 83 is positive. On the other hand, if the signal applied at the terminal 81 is larger, the resultant signal is negative. In this specification, non-inverting and inverting terminals are referred to as positive and negative terminals, respectively, and are so marked in FIG. 3.)

The inventive drive system 10 has a first circuit 85 for generating a signal along the line 87. Such circuit 85 includes a pair of devices such as first and second shaft encoders 89, 91, respectively, which are coupled (directly or through appropriate gearing) to the axle of the first idler wheel 39 and the second idler wheel 37, respectively. When rotated, each encoder 89, 91 emits a number of output pulses per unit time (e.g., "pulses per second") that is proportional to the speed of the idler wheel 39, 37 to which it is coupled. And the rate at which the number of pulses per unit time changes is proportional to the rate of acceleration or deceleration of such idler wheel 39, 37.

The signal from the first encoder 89, denoting the speed of the first truck 27*b*, is applied to the positive terminal 79 of the feedback summing device 93 while that from the second encoder 91 is applied to the negative terminal 81 of the device 93. The resultant summation signal (whether positive, negative or substantially zero) from the output terminal 95 and along the line 97 is applied to a differentiator 99. Such differentiator 99 applies a differential function to the summation signal and provides a signal along the line 87. (The signal may be termed an "acceleration/velocity" signal. Since such signal is a derivative, if the acceleration component becomes zero, the remaining signal represents velocity.)

Such acceleration signal has (a) a magnitude representing the difference between the speed of the first truck 27*b* and the speed of the second truck 27*a*. Such signal also has a polarity denoting that truck 27*b* or 27*a* having the higher speed.

For the following explanation, it will be assumed that the second truck 27*a* is moving at a speed slightly less than that of the first truck 27*b*. This assumption means that the acceleration signal on the line 87 will carry a positive sign. It is also assumed that the speed differential is such that the magnitude of the acceleration signal is one volt. Therefore, such acceleration signal is +1 volt per second.

Referring further to FIG. 3, the system 10 also has a second circuit 101 for receiving the signal on the line 87 and applying first and second modified rate-of-acceleration reference signals to the first and second drives 75, 77, respectively. More specifically, the second circuit 101 has first and second gain constant circuits 103 and 105, respectively, and the first and second summing devices 65 and 69, respectively.

The velocity signal on the line 87 is applied in parallel to the gain constant circuits 103,105 which "scale up" the magnitude of the velocity signal without changing the polarity of such signal. Using the above example and assuming that each circuit 103, 105 has a gain constant of 3, the output signal along each line 107, 109 is ∓volts per second. (In practice, the circuits 103, 105 permit adjusting the gain of each. The actual gain constants of such circuits 103, 105 may differ slightly for "trimming" purposes. It is preferable to have two such circuits 103, 105 since each end of the crane 11 has a different inertia.)

It will be recalled that for the example set out above, the second truck 27*a* is moving at a speed slightly less than that of the first truck 27*b*. The following part of this specification explains how the equalizing signals are used to restore the positions of the two driven trucks 28 to a reference position.

The resultant equalizing signal along the line 109 is applied to a negative terminal 81 of the first summing device 65. Using the output signal of ∓volts per second of the example mentioned above (and recalling that the "plus" algebraic sign of such signal means that the second truck 27*a* is moving at a speed less than that of the first truck 27*b*), the first summing device 65 inverts such ∓volt equalizing signal to a −3 volt signal and algebraically combines such signal with the command signal along the line 63.

Such command signal is a positive signal for the direction of commanded motor rotation assumed for this example and it is also assumed that the magnitude of such command signal is +7 volts per second. Therefore, the signal applied to the drive 75 along the line 71, referred to as a first modified rate-of-acceleration reference signal, is +7 volts algebraically added to −3 volts or +4 volts per second. Since +4 volts is somewhat less than the +7 volt command signal resulting from the setting of the master switch 49, the first motor 35 comes to a slightly lower rate of acceleration and the speeds of the motors 33, 35 are thereby brought substantially equal to one another.

Similarly, the equalizing signal along the line 107 is applied to a positive terminal 79 of the second summing device 69. Using the output signal of ∓volts per second of the example mentioned above, the second device 69 does not invert such ∓volt equalizing signal. Rather, such ∓volt signal is combined with the +7 volt signal resulting from the speed setting of the master switch 49.

Therefore, the signal applied to the drive 77 along the line 73, referred to as a second modified speed reference signal, is +7 volts increased by ∓volts or +10 volts per second. Since +10 volts is somewhat greater than the +7 volt signal resulting from the setting of the master switch 49, the second motor 33 increases speed slightly if it is not so heavily loaded as to be prevented from doing so.

It is to be appreciated that the magnitude of the difference in speed between the first truck 27*b* and the second truck 27*a* may change more-or-less continuously. It is also to be appreciated that the first truck 27*b* may be leading or lagging the second truck 27*a* at any particular moment. The above description involves an instantaneous "snapshot" of a particular relationship at a particular exemplary instant.

In one preferred method and embodiment of the system, modified rate-of-acceleration reference signals are simultaneously applied to the drives 75, 77. In a two-drive system, that drive 75 or 77 then having the higher rate of acceleration has such rate reduced while that drive 77 or 75 then having the lower rate of acceleration has its rate increased. If not prevented by motor loading (as explained below) this approach will bring the driven trucks 28 into position correspondence more rapidly than the approach described immediately below.

However, it is also possible to apply a modified rate-of-acceleration reference signal to but a single drive 75 or 77, preferably that drive 75 or 77 coupled to the motor 35 or 33 then having the higher rate of acceleration. In such an arrangement, the gain constant circuit 103 is configured to accept velocity signals having only negative polarity and the gain constant circuit 105 is configured to accept velocity signals having only positive polarity.

In such an arrangement, the resulting modified speed reference signal functions to reduce the rate of acceleration of the "leading" motor 35 or 33 rather than to increase the rate of acceleration of the lagging motor 33 or 35. In fact, if the lagging motor 33 or 35 is then accelerating at the most rapid rate possible given its then-existing loading, applying a modified (reduced) rate-of-acceleration reference signal to the leading motor 35 or 33 is all that is required.

From the foregoing, it will now be apparent how the new method and system 10 function to maintain components such as trucks 27*a*, 27*b* substantially coincident with their reference positions (at the axis 47 shown in FIG. 2) or to bring such trucks 27*a*, 27*b* to such positions. It will also be apparent that if the trucks 27*a*, 27*b* are maintained substantially at such reference positions, crane skewing is substantially avoided.

Referring again to FIG. 3, the new system 10 also has a threshold limit comparator 111 having a limiting input 113. Such input is a preselected (but manually adjustable) value of the differential signal along the line 97. The differential signal itself (along line 97) is another input to the comparator 111. If the differential signal exceeds the limiting input 113, the comparator 111 provides a disabling signal along the line 115 to shut down the system 10.

Examples of circumstances in which the comparator 111 shuts down the system 10 include a brake which fails to release or a command signal which disappears because of a faulty encoder 89, 91. And if the crane 11 is so eccentrically loaded that the speeds of the trucks 27*a*, 27*b* become excessively disparate, the differential signal becomes sufficiently large to "trigger" the comparator 111 and shut down the system 10.

It will be recalled that the encoders 89, 91 provide spike-like "pulses" or signals, the number of which per unit time represents the speed of a truck 27. However, from the foregoing, it will also be appreciated that the number of pulses counted without regard to the passage of time will represent the actual position of a truck 27 (and, therefore, of the crane 11) with respect to some "zero" or reference point.

The new system 10 may also include a line 117 on which there is a signal representing the actual position of the crane 11 with respect to some reference point, e.g., the end of a rail 31. Such signal can be used to actuate slow-down points and emergency stop points.

For example, it is assumed that the rails 31 are each 200 feet in length, that each truck 27 traverses 3 feet for each revolution of an idler wheel 37, 39 and that an encoder 89 or 91 provides 1000 pulses for each revolution of the idler wheel 37 or 39 to which it is coupled. It is also assumed that the crane 11 is at one end of the rails 31. A "count" of 60,000 pulses means that the crane has traversed 180 feet toward the other rail end. The formula is [60,000 pulses divided by 1000 pulses/revolution]×3 feet/revolution=180 feet. The new system 10 may be arranged so that upon reaching an exemplary count of 60,000 pulses, the drives 75, 77 are disabled and the crane 11 is stopped.

Preferably, the system 10 maintains the trucks 27*a*, 27*b* reasonably proximate to a reference axis 47. Most preferably, the system 10 maintains such trucks coincident with such axis 47.

To that end, the system 10 also includes first and second proportional gain constant circuits 119 and 121, respectively and first and second integral gain constant circuits 123 and 125, respectively. The latter circuits 123, 125 receive a signal from an integrator 127 and the proportional circuits 119, 121 provides instantaneous correction of an error signal. However, using only such circuits 119, 121 cannot reduce the error to zero for as soon as the error becomes zero, no correction is applied and the system 10 behaves as if no feedback existed. And increasing the proportional gain is not a solution to this problem as this leads to drastic overshoots and instabilities.

The integral gain constant circuits 123, 125 accumulate non-zero proportional offset errors and correct for them. Such circuits 123, 125 are relatively slow to react to errors and, thus, are effective in improving the steady state response of the system 10. Stated another way, such circuits 123, 125 introduces "phase lag" into the system 10.

The derivative circuits 103, 105 introduce some "phase lead" to the system 10 and are, in effect, "predictors" of the future state of the system 10. For example, if the error is rapidly approaching zero, the signals from the circuits 103, 105 will be relatively large and negative in polarity. This effectively slows the system 10 in anticipation of overshooting the "target" of zero error; that is, the circuits 103, 105 dramatically reduce the tendency to "overshoot."

While the principles of the invention have been described in connection with specific embodiments, it is to be understood clearly that such embodiments are exemplary and are not limiting.

What is claimed is:

1. In a machine having at least two components, each driven by a separate motor, a method for maintaining the positions of each of the components substantially coincident with a component reference position and including the steps of:

providing a differential signal representing a difference between the speeds of the components;

providing a rate-of-acceleration reference signal;

generating an equalizing signal reducing the rate of acceleration of the higher-speed component; and algebraically combining the rate-of-acceleration reference signal and the equalizing signal.

2. In a material-handling machine having first and second idler wheels mounted to respective first and second components, each component being driven by a separate AC motor connected to a respective variable-frequency inverter, and wherein the idler wheels are mechanically disconnected from one another, a method for maintaining the positions of each of the components substantially coincident with a component reference position and including the steps of:

algebraically summing electrical first and second signals, such first and second signals representing the rotational speeds of the first and second idler wheels, respectively;

providing a differential signal representing a difference between the speeds of the idler wheels; and generating an equalizing signal reducing the rate of acceleration of the higher-speed idler wheel.

3. The method of claim 2 wherein the summing step provides a summation signal and the providing step includes the step of applying a differential function to the summation signal, thereby generating a velocity signal having (a) a magnitude representing the difference between the speed of the first component and the speed of the second component, and (b) a polarity denoting that component having the greater speed.

4. The method of claim 3 wherein the summing step includes the steps of:

providing an encoder emitting output pulses at a rate proportional to the speed of the first idler wheel; and generating the first signal.

5. The method of claim 2 including the steps of:

providing a rate-of-acceleration reference signal; and algebraically combining the rate-of-acceleration reference signal and the equalizing signal.

6. The method of claim 3 including the steps of:

providing a rate-of-acceleration reference signal; and algebraically combining the rate-of-acceleration reference signal and the equalizing signal.

7. The method of claim 2 wherein the equalizing signal is a first equalizing signal and the method includes the step of:

generating a second equalizing signal increasing the rate of acceleration of the lower-speed component.

8. In a material handling machine having at least two components, each driven by a separate AC motor, a method for maintaining the positions of each of the components substantially coincident with a component reference position and including the steps of:

providing an electrical differential signal representing a difference between the speeds of the components; and generating an electrical equalizing signal increasing the rate of acceleration of the lower-speed component while maintaining the rate of acceleration of the higher-speed component.

9. The method of claim 8 wherein the providing step includes the steps of:

generating a first electrical signal representing the speed of the first component;

generating a second electrical signal representing the speed of the second component; and algebraically summing the first signal and the second signal, thereby providing a summation signal.

10. In a machine having plural components, each driven by a separate motor, a method for maintaining the positions of each of the components substantially coincident with a component reference position including the steps of:

providing a rate-of-acceleration reference signal;

generating a first signal representing the speed of the first component;

generating a second signal representing the speed of the second component;

algebraically summing the first signal and the second signal, thereby providing a summation signal;

applying a differential function to the summation signal, thereby generating a velocity signal having (a) a magnitude representing the difference between the speed of the first component and the speed of the second component, and (b) a polarity denoting that component having the higher speed;

generating an equalizing signal for reducing the rate of acceleration of the higher-speed component; and algebraically combining the rate-of-acceleration reference signal and the equalizing signal.

11. The method of claim 10 wherein the equalizing signal is a first equalizing signal and the method also includes the step of:

generating a second equalizing signal increasing the rate of acceleration of the lower-speed component.

12. The method of claim 10 wherein the machine is a material-handling machine having a bridge and the components are first and second structures supporting the bridge.

13. The method of claim 10 wherein the machine is a material-handling machine having a bridge and the components are first and second structures supporting the bridge.

14. In a drive system having (a) a device for providing a motor rate-of-acceleration reference signal, (b) first and second motors driving first and second components, respectively, and (c) first and second drives receiving the reference signal and powering the first and second motors, respectively, the improvement wherein the system includes:

a first circuit for generating a velocity signal having (a) a magnitude representing the difference between the speed of the first component and the speed of the second component, and (b) a polarity denoting that component having the higher speed;

a second circuit for receiving the velocity signal and applying a modified rate-of-acceleration reference signal to the first drive.

15. The system of claim 14 wherein the modified rate-of-acceleration reference signal is a first modified rate-of-acceleration reference signal and the second circuit also applies a second modified rate-of-acceleration reference signal to the second drive.

16. The system of claim 15 wherein:

the first modified speed reference signal tends to reduce the speed of the first motor; and the second modified speed reference signal tends to increase the speed of the second motor.

17. In a machine having at least first and second components, each driven by a separate motor, a method for maintaining the positions of each of the components substantially coincident with a component reference position and including the steps of:

providing a differential signal representing a difference between the speeds of the components; such providing step including the steps of:

generating a first signal representing the speed of the first component;

generating a second signal representing the speed of the second component;

algebraically summing the first signal and the second signal, thereby providing a summation signal;

applying a differential function to the summation signal, thereby generating a velocity signal having (a) a magnitude representing the difference between the speed of the first component and the speed of the second component, and (b) a polarity denoting that component having the greater speed; and the method further includes the step of:

generating an equalizing signal reducing the rate of acceleration of the higher-speed component.

18. The method of claim 17 wherein the step of generating the first signal includes providing an encoder emitting output pulses at a rate proportional to the speed of the first component.

19. The method of claim 17 including the steps of:

providing a rate-of-acceleration reference signal; and algebraically combining the rate-of-acceleration reference signal and the equalizing signal.

* * * * *